US011359266B2

(12) United States Patent
Yang et al.

(10) Patent No.: US 11,359,266 B2
(45) Date of Patent: Jun. 14, 2022

(54) HIGH ENTROPY ALLOY STRUCTURE AND A METHOD OF PREPARING THE SAME

(71) Applicant: City University of Hong Kong, Kowlonn (HK)

(72) Inventors: Yong Yang, Kowloon Tong (HK); Zhaoyi Ding, Kowloon Tang (HK); Quanfeng He, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 697 days.

(21) Appl. No.: 16/196,224

(22) Filed: Nov. 20, 2018

(65) Prior Publication Data

US 2020/0157663 A1 May 21, 2020

(51) Int. Cl.

| | |
|---|---|
| ***C22C 30/00*** | (2006.01) |
| ***C22F 1/16*** | (2006.01) |
| ***C22C 1/02*** | (2006.01) |

(52) U.S. Cl.

CPC ..... *C22C 30/00* (2013.01); *C22C 1/02* (2013.01); *C22F 1/16* (2013.01)

(58) Field of Classification Search

CPC ..... C22C 30/00

See application file for complete search history.

(56) References Cited

U.S. PATENT DOCUMENTS

2008/0031769 A1* 2/2008 Yeh ..... C22C 1/03 420/580
2017/0209922 A1* 7/2017 Kato ..... B22F 1/0014
2017/0218480 A1* 8/2017 Park ..... C23F 1/30

FOREIGN PATENT DOCUMENTS

CN 104674103 B * 1/2017

OTHER PUBLICATIONS

Walker et al. CRC Handbook of Metal Etchants. CRC Press, 1991 (Year: 1991).*

Espacenet machine translation of CN-104674103-B retrieved on Aug. 14, 2021 (Year: 2017).*

* cited by examiner

*Primary Examiner* — Jophy S. Koshy
*Assistant Examiner* — Joshua S Carpenter
(74) *Attorney, Agent, or Firm* — Renner Kenner Greive Bobak Taylor & Weber

(57) ABSTRACT

A method for preparing a high entropy alloy (HEA) structure includes the steps of: preparing an alloy by arc melting raw materials comprising five or more elements; drop casting the melted alloy into a cooled mold to form a bulk alloy with eutectic microstructure therein; and subjecting the bulk alloy to an acidic condition to form a bulk porous structure with eutectic microstructure therein. A high entropy alloy structure is also provided as prepared by the method.

16 Claims, 8 Drawing Sheets

HIGH ENTROPY ALLOY STRUCTURE AND A METHOD OF PREPARING THE SAME

TECHNICAL FIELD

The present invention relates to a high entropy alloy structure and a method of preparing the high entropy alloy structure, specifically, although not exclusively, to a high entropy alloy with eutectic microstructures and a method of preparing a high entropy alloy with eutectic microstructures.

BACKGROUND

With respect to the human history, human civilization has striven to develop, discover and invent new materials for more than thousands of years. Since the Bronze Age, alloys have traditionally been developed according to a "base element" paradigm. That is, choosing one or rarely two principle elements such as iron in steels or nickel in superalloys for its properties, and a minor alloying approach to obtain the alloys. This kind of alloys may be used as coins, gate valves, tools, weapons, etc.

BRIEF DESCRIPTION OF THE DRAWINGS

Embodiments of the present invention will now be described, by way of example, with reference to the accompanying drawings in which.

SUMMARY

Figure 1:
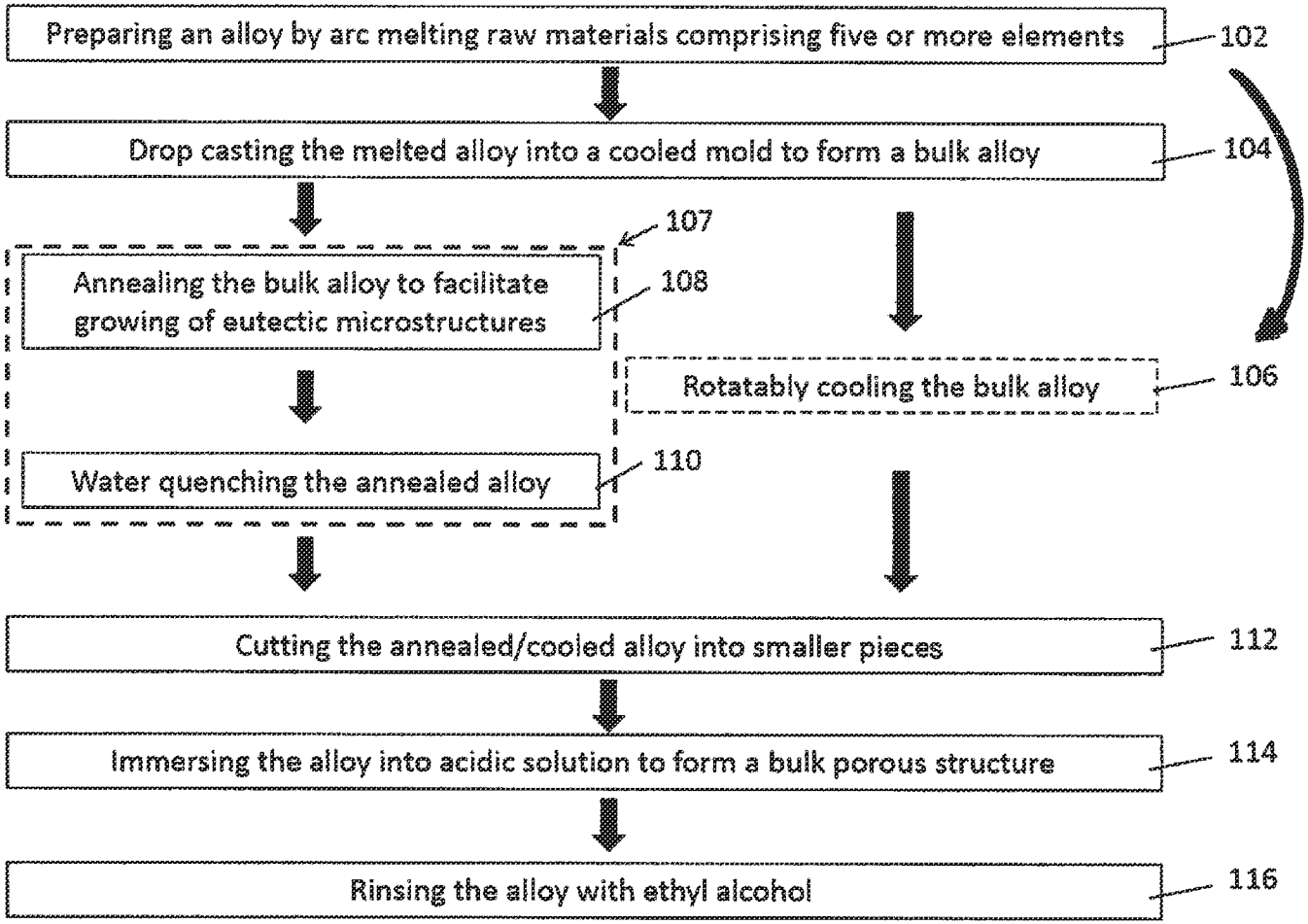
FIG. 1 is a block diagram showing the process flow of a method for preparing a high entropy alloy structure in accordance with one embodiment of the present invention.

In accordance with the first aspect of the present invention, there is provided a method for preparing a high entropy alloy (HEA) structure comprising the steps of: preparing an alloy by arc melting raw materials comprising five or more elements; drop casting the melted alloy into a cooled mold to form a bulk alloy with eutectic microstructure therein; and subjecting the bulk alloy to an acidic condition to form a bulk porous structure with eutectic microstructure therein.

In an embodiment of the first aspect, the method further includes step B1, after step B, of rotatably cooling the bulk alloy.

In an embodiment of the first aspect, the method further includes step B1', after step B, of heat-treating the bulk alloy to form a bulk structure with coarsened eutectic microstructure therein.

In an embodiment of the first aspect, step B1' includes step B2' of annealing the bulk alloy to facilitate growing of eutectic microstructures.

In an embodiment of the first aspect, step B1' further includes step B3', after step B2', of water quenching the annealed alloy.

In an embodiment of the first aspect, step C includes step C1 of immersing the alloy into an acidic solution to form the bulk porous structure.

In an embodiment of the first aspect, the method further includes step C0, prior to step C, of cutting the annealed alloy into smaller piece.

In an embodiment of the first aspect, the raw materials are provided in approximately equal atomic ratios.

In an embodiment of the first aspect, the raw materials are Cobalt, Chromium, Iron, Nickel and Niobium.

In an embodiment of the first aspect, Cobalt, Chromium, Iron, Nickel and Niobium are provided in the atomic ratios of 1:1:1:1:0.48.

In an embodiment of the first aspect, the raw materials have a high purity of >99.90%.

In an embodiment of the first aspect, the mold is made of copper.

In an embodiment of the first aspect, the alloy in step A is arc melted within an argon atmosphere with a pressure less than $8\times10^{-4}$ Pa In an embodiment of the first aspect, the alloy in step B1 is rotatably cooled within an argon atmosphere with a pressure less than $1\times10^{-3}$ Pa.

In an embodiment of the first aspect, the bulk alloy is annealed at a temperature of at least 800° C. or at least 60% of the alloy melting point for at least 5 hours.

In an embodiment of the first aspect, the alloy in step C is immersed into an acidic solution including dilute Aqua Regia at 50-100° C. for at least 2 hours.

In an embodiment of the first aspect, the alloy is rinsed for at least 3 minutes with ethyl alcohol.

In accordance with the second aspect of the invention, there is provided a high entropy alloy structure prepared by the method in accordance with the first aspect.

In an embodiment of the second aspect, the distance between the ligaments of the alloy structure is positively correlated with the temperature and duration of the heat treatment of the alloy in step B1'.

In an embodiment of the second aspect, the hydrophobic property of the alloy structure is positively correlated with the distance between the ligaments.

In an embodiment of the second aspect, the Hydrogen Evolution Reaction (HER) property of the alloy structure is positively correlated with the specific surface area of the alloy structure.

In an embodiment of the second aspect, the specific surface area of the alloy structure is negatively correlated with the size of the ligaments of the alloy structure.

In an embodiment of the second aspect, the high entropy alloy structure processed by the method includes strong and hard ligaments.

In an embodiment of the second aspect, the hardness of the structure is in the range of 60-260 HV.

In an embodiment of the second aspect, the structure obtained in step B1 or B1' is a dual phase eutectic structure.

In an embodiment of the second aspect, the dual phase includes face centre cubic (FCC) phase and Laves phase.

In an embodiment of the second aspect, the structure obtained in step C is a single phase eutectic structure.

In an embodiment of the second aspect, the single phase includes a Laves phase.

DETAILED DESCRIPTION

High Entropy Alloys (HEAs) are a new kind of alloy typically composed of five or more elements with near equi-atomic ratio and no principal/dominant element. These alloys, however, usually possess relatively a single phase structure, which may lead to a failure in combining different mechanical properties such as strength and ductility.

Without wishing to be bound by theories, the inventors have, through their own research, trials, and experiments, devised a new alloy material, eutectic high entropy alloys (EHEAs) and a method of preparing the same. The EHEAs may contain multiphases with nanometer length scale. Comparing with conventional eutectic alloys, EHEAs having multiple elements in each phase may result in a synergistic effect of multicomponents such that optimal mechanical and functional properties may be achieved. In some embodiments, the EHEAs may further be processed to possess porous microstructures therein, which may allow the EHEAs to be used in various applications.

With reference to FIG. 1, there is provided a block diagram showing the process flow of a method for preparing a high entropy alloy (HEA) structure. The method comprises the steps of: preparing an alloy by arc melting raw materials comprising five or more elements; drop casting the melted alloy into a cooled mold to form a bulk alloy with eutectic microstructure therein; and subjecting the bulk alloy to an acidic condition to form a bulk porous structure with eutectic microstructure therein.

As shown, in step 102, an alloy is prepared by arc melting raw materials comprising five or more elements. For instance, specific composition of elements may be selected for forming alloy with desirable eutectic microstructure that would be suitable for various applications. The raw materials may be independently selected from the elements of groups 4-12 in period 4-7 in the periodic table or the elements of lanthanide series in the periodic table, particularly from the elements of groups 4-12 in period 4-7, preferably from the elements of groups 4-12 in period 4-5. Most preferably, the raw materials are Cobalt, Chromium, Iron, Nickel and Niobium. The total weight of the raw materials may be at least 40 grams or above. The elements may also be provided in approximately equal atomic ratios. In this example, the atomic ratios of the raw materials are 1:1:1:1:0.48. Specifically, the raw materials, Cobalt, Chromium, Iron, Nickel and Niobium are provided with an atomic percentage of 22.32%, 22.32%, 22.32%, 22.32%, and 10.72%. The raw materials may be of a high purity such as >90%, particularly >95%, preferably >99%, further preferably >99.90%, or most preferably >99.95%.

The aforementioned raw materials may be melted in an arc furnace under an inert atmosphere. Preferably, the arc furnace is pump-filled with argon gas for at least 5 times such that the pressure inside the furnace is less than $8\times10^{-4}$ Pa.

Once the raw materials are arc melted, the resultant material, that is the melted alloy, may be drop casted into a cooled mold to form a semi-finished product in step 104. Preferably, the melted alloy may be drop casted into a copper mold cooled with water so as to obtain a bulk alloy with eutectic microstructure.

The thus-obtained bulk alloy may then be subjected to a specific heat treatment 107 so as to tune the optimum size of the microstructure therein. The heat treatment 107 involves steps 108 and 110. In step 108, the bulk alloy is annealed to facilitate growing of the eutectic microstructures i.e. microstructure evolution by ligament coarsening to micro meter scale from nanometer scale. To carry out the annealing process, the bulk alloy may be heated to at least 800° C., particularly at least 900° C., preferably at least 1000° C. or to a temperature at least 60% of the alloy melting point for at least 5 hours, preferably at least 6 hours in the furnace. In one example, the temperature and the duration of the annealing process may influence the growth of microstructures. It is appreciated that a skilled person may adjust the annealing temperature and duration according to their technical needs to provide different properties for serving different purposes.

The annealed alloy is then taken out from the furnace and directly quenched with water so as to obtain a bulk alloy with coarsened eutectic microstructures therein in step 110.

Afterwards, the annealed alloy may be further processed by cutting into smaller pieces in step 112, followed by immersing these small pieces into an etching solution so as to obtain a bulk porous structure in step 114. The process may also refer as a dealloying process. The etching solution may be an acidic solution particularly a dilute Aqua Regia. Preferably, the etching process is carried out by immersing the small pieces of annealed alloy into the dilute Aqua Regia under a water shower at 50-100° C. for at least 2 hours. Finally, the aforementioned alloy may be rinsed for at least 3 minutes with ethyl alcohol to remove any residues or acidic solution left behind in step 116. As such, a porous HEA with eutectic microstructures therein is obtained.

In another embodiment, the melted alloy obtained in step 102 may be drop casted to a mold such as a copper mold cooled by water, liquid nitrogen or the like in step 104 to obtain a bulk alloy. The thus-obtained bulk alloy i.e. the as-cast alloy may be directly proceeded to steps 112 to 116 to form a porous as-cast HEA structure with eutectic microstructures therein.

In yet another embodiment, the melted alloy obtained in step 102 may be rotatably cooled in step 106 to form an as-spun alloy. Preferably, the melted alloy is rotatably cooled during a melt spinning process under an inert atmosphere. In this example, the melt spinning process is carried out in an area pump-filled with argon such that the pressure within the area is less than $1\times10^{-3}$ Pa. The as-spun alloy obtained in step 106 may then be directly etched in step 114 and rinsed in step 116 to obtain a porous as-spun HEA structure with eutectic microstructures therein By going through different preparation steps, the HEAs prepared may have various morphologies and microstructures. For example, the microstructures may have different forms, spaces, distances, etc. which may in turn affect the properties of the HEAs. The morphologies and microstructures of the prepared HEAs may be characterized by methods known in the art such as scanning electron microscopy (SEM).

Figure 2A:
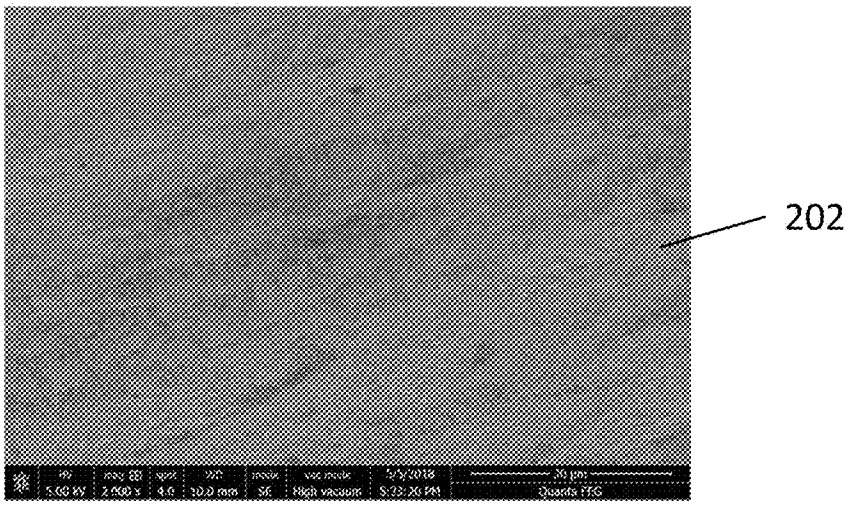
FIG. 2A is a scanning electron microscopy image of an as-cast high entropy alloy as prepared in accordance with one embodiment, magnification: 2000×.
Figure 2B:
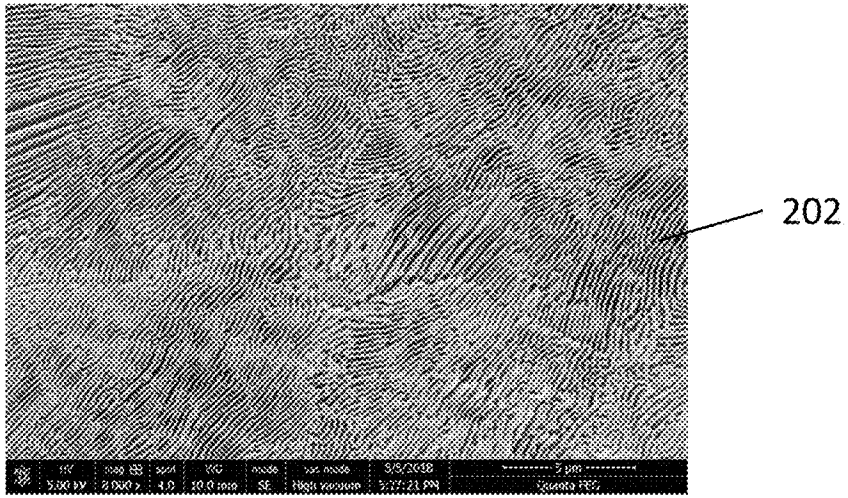
FIG. 2B is a magnified scanning electron microscopy image of FIG. 2A, magnification: 8000×.

With reference to FIGS. 2A and 2B, there are provided the SEM images of HEAs prepared by the method as described above. In this example, the HEA is an as-cast alloy 202 obtained in step 104 without undergoing the annealing process 108. The as-cast alloy 202 was directly cut into smaller pieces and etched prior to SEM imaging. As shown in FIG. 2A, the HEA structure 202 showed a uniform lamellar structure. Upon magnifying the surface to 8000× (FIG. 2B), it was found that the surface of HEA structure 202 was occupied by ligament- or lamellar-like microstructures with around 100 nm length scale. The microstructures were closely packed with limited space between each of the ligaments. This may be advantageous in that the HEA structure 202 may provide a tremendous specific area for various applications such as catalysis.

Figure 3A:
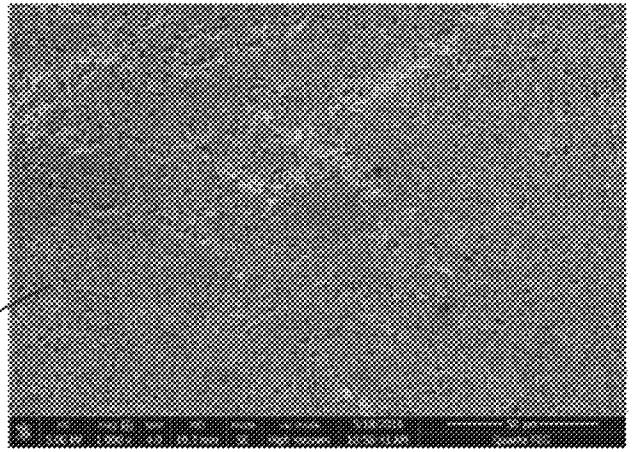
FIG. 3A is a scanning electron microscopy image of an as-cast high entropy alloy annealed at 1000° C. as prepared in accordance with one embodiment, magnification: 2000×.
Figure 3B:
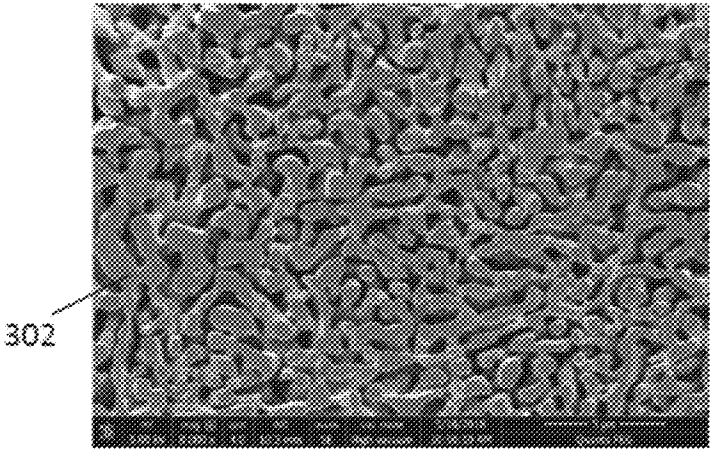
FIG. 3B is a magnified scanning electron microscopy image of FIG. 3A, magnification: 8000×.
Figure 3C:
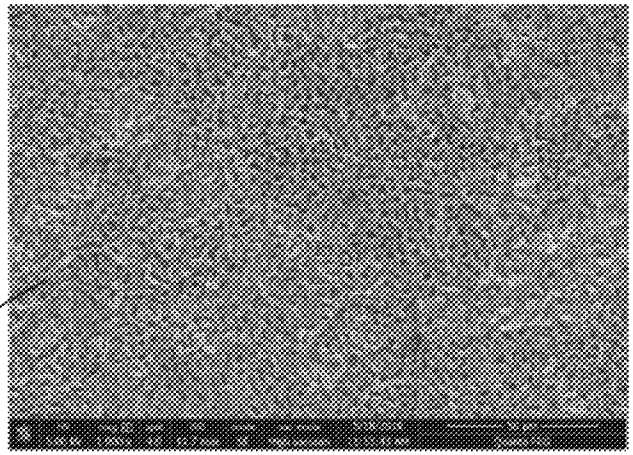
FIG. 3C is a scanning electron microscopy image of an as-cast high entropy alloy annealed at 1200° C. as prepared in accordance with one embodiment, magnification: 2000×.
Figure 3D:
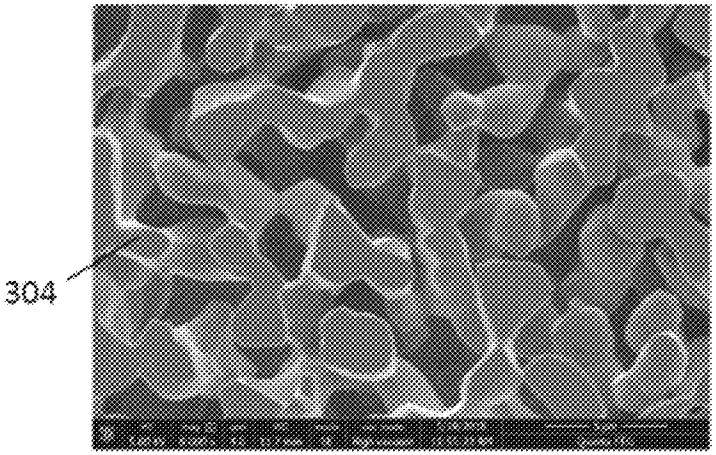
FIG. 3D is a magnified scanning electron microscopy image of FIG. 3C, magnification: 8000×.

With reference to FIGS. 3A to 3D, there are provided the SEM images of annealed HEAs prepared by the method as described above. In this embodiment, the HEAs 302 and 304 are as-cast alloys obtained in step 104 and being annealed at 1000° C. and 1200° C. for 6 hours, respectively. The annealed HEA was cut into smaller pieces and etched prior to SEM imaging. As shown, the surfaces of the annealed HEA structures 302 (FIG. 3A) and 304 (FIG. 3B) were much rougher as compared the HEA structure 202 (FIG. 2A). The surfaces of the annealed HEA structures 302 and 304 include a plurality of porous space and isolated ligament-like structures. In particular, the ligaments in HEA 304 (FIG. 3D) was found to be less continuous as compared with those in HEA 302 (FIG. 3B). That is, the distance between each of the ligaments in HEA 304 (FIG. 3D) were generally larger than those in HEA 302 (FIG. 3B). This may suggest that the distance between each of the ligaments in HEA is positively correlated with the temperature and/or duration of the annealing process. As such, it may be advantageous in that the distance between the ligaments and therefore the properties of the HEA may be tuned readily.

Figure 4A:
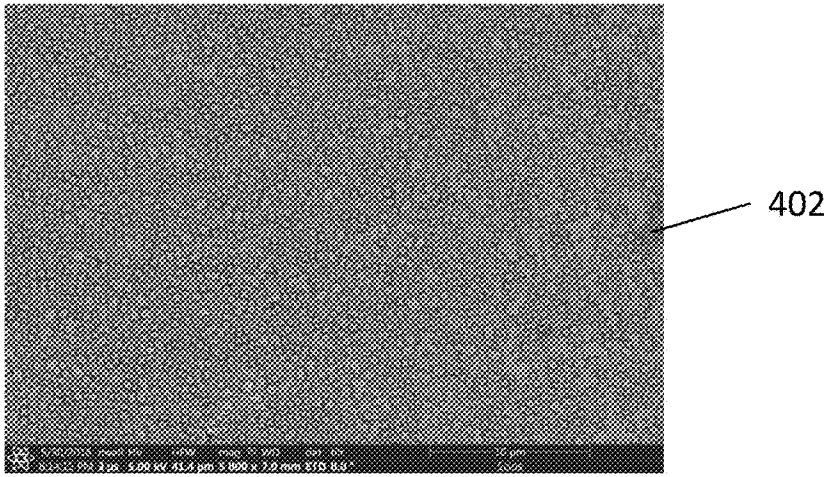
FIG. 4A is a scanning electron microscopy image of an as-spun high entropy alloy as prepared in accordance with one embodiment, magnification: 5000×.
Figure 4B:
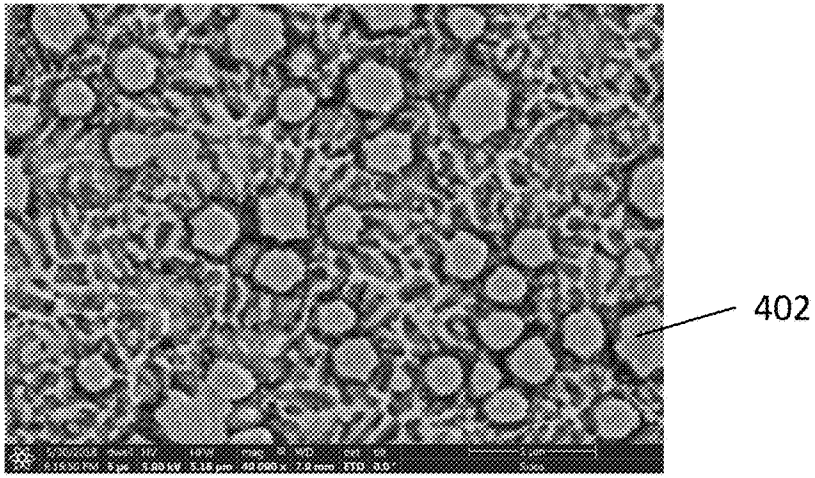
FIG. 4B is a magnified scanning electron microscopy image of FIG. 4A, magnification: 40000×.

With reference to FIGS. 4A and 4B, there is provided the SEM images of an as-spun HEA as prepared by the method described above. In this example, the as-spun HEA 402 obtained from step 106 was directly etched, followed by being characterized with SEM. As shown in FIG. 4A, the as-spun HEA 402 possesses a rough surface. The magnified images of FIGS. 4A to 4B indicated that the surface was occupied by a plurality of globular structures being connected with a ligament network. That is, there are two forms of structure observed in the as-spun HEA 402 resulting from the rapid cooling of the melt spinning process and the dealloying process.

Figure 5A:
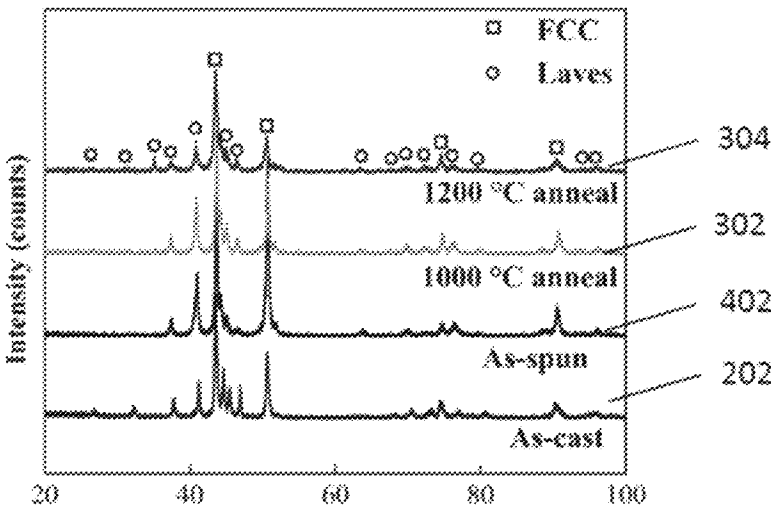
FIG. 5A is X-ray diffraction diagrams showing the X-ray diffraction patterns of the high entropy alloys as prepared in accordance with one embodiment.

Without wishing being bound by the theories, the inventors devised that the HEA prepared by the aforementioned method possesses multiphases particularly dual phases. With reference to FIG. 5A, there is provided an X-ray diffraction (XRD) diagram showing the X-ray diffraction pattern of the HEA structures prepared by the aforementioned method without undergoing the etching step 114. As shown, the as-cast HEA 202, the annealed as-cast HEAs 302 and 304 as well as the as-spun HEA 402 all possess dual phases, namely face centre cubic (FCC) and Laves phases.

Figure 5B:
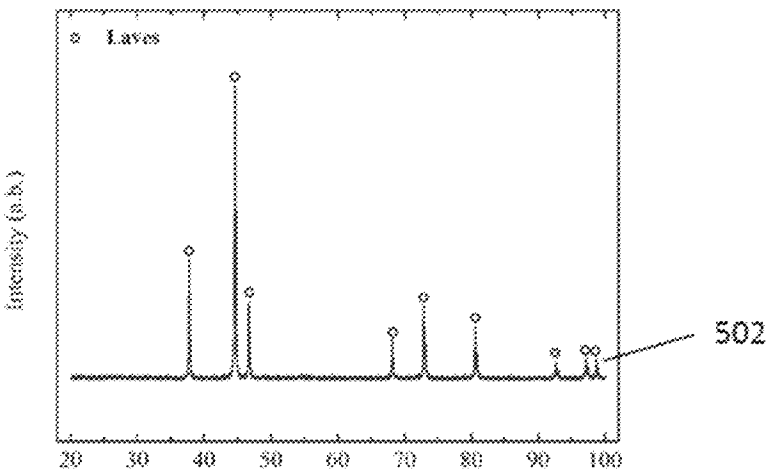
FIG. 5B is an X-ray diffraction diagram showing the X-ray diffraction pattern of a porous high entropy alloy as prepared in accordance with one embodiment.

The inventor further devised that any of the HEA structures mentioned above may have a single phase structure upon subjecting to the etching step 114. As shown in FIG. 5B, there is provided an XRD diagram of an as-cast HEA structure 502 obtained in step 104 of the aforementioned method. The HEA structure 502 was etched in accordance with step 114 prior to XRD analysis. It is clear from FIG. 5B that the HEA structure 502 possesses a single phase, namely the Laves phase. This may be a consequence of a selective dealloying of the FCC phase microstructures, leaving the Laves phase microstructures behind and therefore a porous HEA structure. As a result, large specific area of mixed multi transitional metal is exposed, which enable them a great potential of variety of applications.

Figure 6B:
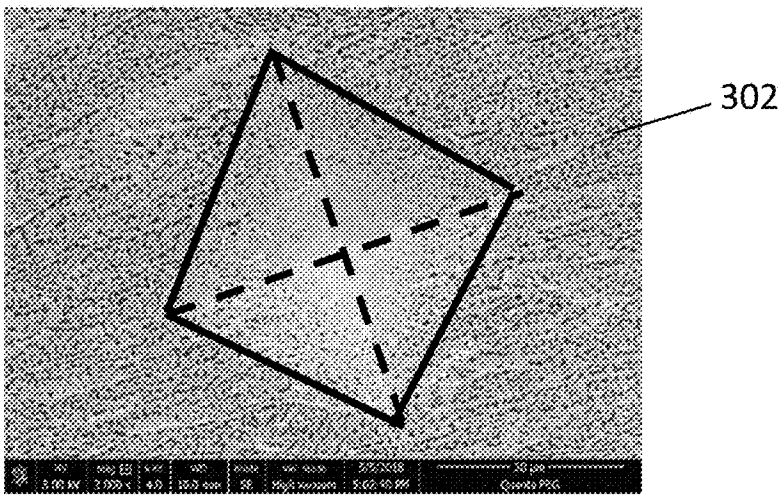
FIG. 6B is a scanning electron microscopy secondary electron image showing a residual indent on an as-cast high entropy alloy annealed at 1000° C. as prepared in accordance with one embodiment.
Figure 6A:
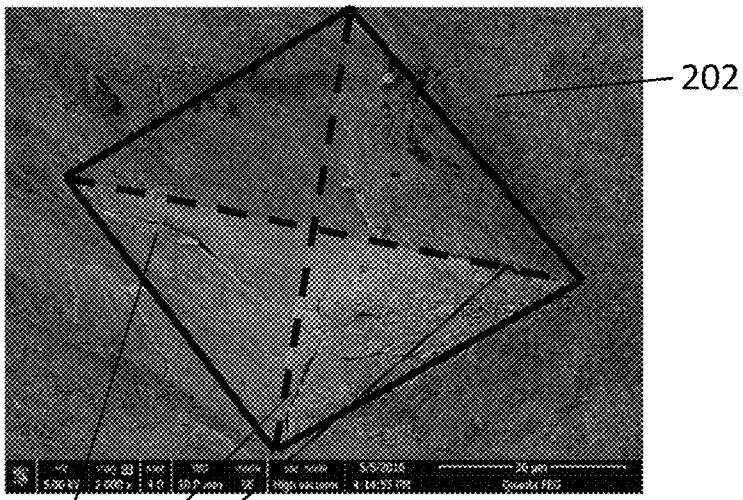
FIG. 6A is a scanning electron microscopy secondary electron image showing a residual indent on an as-cast high entropy alloy as prepared in accordance with one embodiment.
Figure 6C:
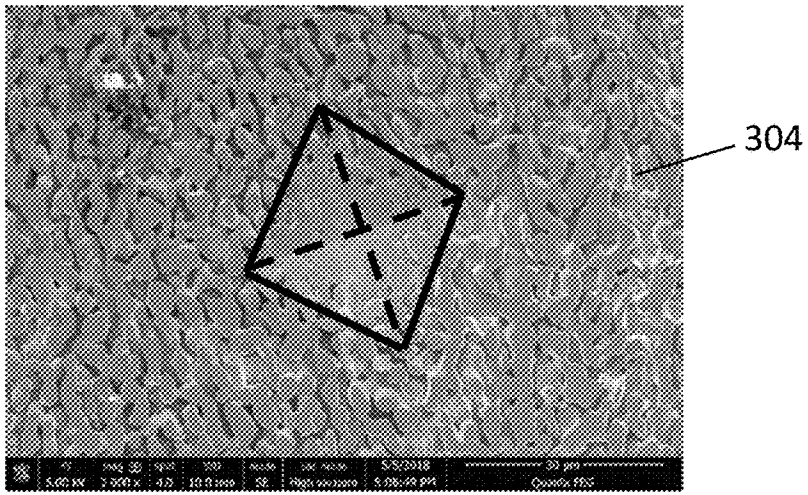
FIG. 6C is a scanning electron microscopy secondary electron image showing a residual indent on an as-cast high entropy alloy annealed at 1200° C. as prepared in accordance with one embodiment.

With reference to FIGS. 6A to 6C, there are provided the SEM secondary electron images of indentation on the HEAs as prepared in the aforementioned embodiments. In each of the figures, there is a solid square with dashed diagonal lines indicating a residual indent, which represents the location where an indenter was applied. Each of the HEAs discussed below were subjected to the etching process in step 114 prior to analysis. As shown in FIG. 6A, the as-cast HEA 202, in the absence of the annealing step 108, possesses a plurality of residual cracks 602. Such residual cracks are missing from the annealed HEAs 302 and 304 as shown in FIGS. 6B to 6C, which suggests the importance of the annealing process 108 in providing strong and hard ligaments in the HEAs. It is aware by the skilled person in the art that the indentation size may be used to measure the hardness and estimate the density of a material. In this example, the hardness of the HEAs was measured as 60-260 HV whereas the density was estimated to be about 4 g/cm$^3$.

As mentioned above, one of the advantages of the present invention is that the distance and size of the ligaments of HEAs may be tuned by adjusting the annealing temperature and duration. This may in turn adjust the specific surface area as provided by the HEAs for various applications such as catalysing hydrogen evolution reaction (HER) to generate hydrogen.

The size of the ligaments of the HEAs as described above may affect the HER property of the HEAs. Preferably, the HER property of HEAs is positively correlated with the specific surface area of the HEAs, whilst the specific surface area of the HEAs is negatively correlated with the size of the ligaments of the HEAs.

Figure 7:
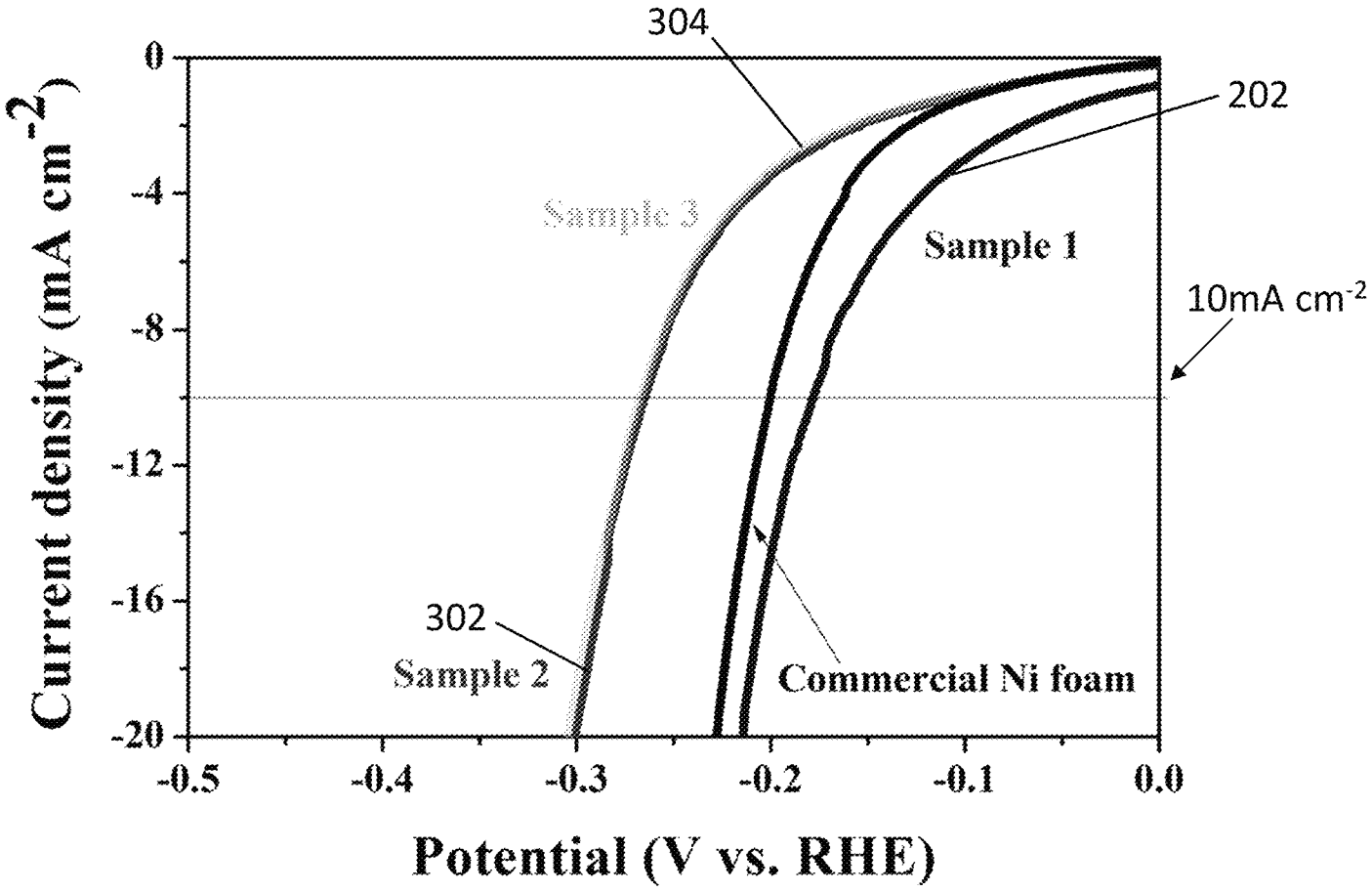
FIG. 7 is a plot of current density against potential showing the Hydrogen Evolution Reaction properties of the high entropy alloys as prepared in accordance with one embodiment with respect to a commercial Ni foam.

With reference to FIG. 7, there is provided a plot of current density against potential showing the HER property of HEAs prepared in the aforementioned embodiments with respect to a commercial Ni foam. As shown, with reference to a constant current density such as 10 mA cm$^{-2}$, the over-potential values of the porous as-cast HEA 202 as well as the porous annealed as-cast HEAs 302, 304 obtained in step 114 were determined to be 0.17V, 0.26V, and 0.27V respectively whereas the over-potential value of the commercial Ni foam was determined to be 0.2V. It is appreciated that since a smaller over-potential value indicates a higher reactivity of a material, the porous as-cast HEA 202 with the smallest ligament size among all three HEAs showed a superior HER property over the commercial Ni foam.

The distance between the ligaments of the HEAs as described above may also affect the hydrophobic property of the HEAs. Preferably, the hydrophobic property of the HEAs is positively correlated to the distance between the ligaments.

Figure 8A:
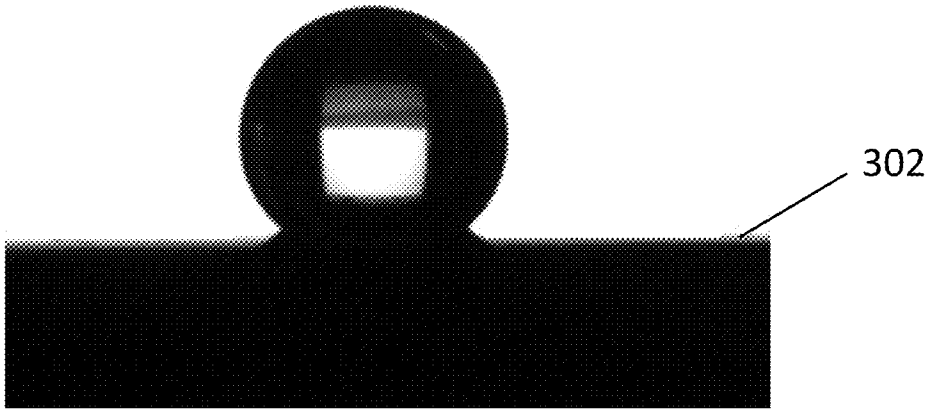
FIG. 8A is an image showing the contact angle of a water droplet on the surface of an as-cast high entropy alloy annealed at 1000° C. as prepared in accordance with one embodiment.
Figure 8B:
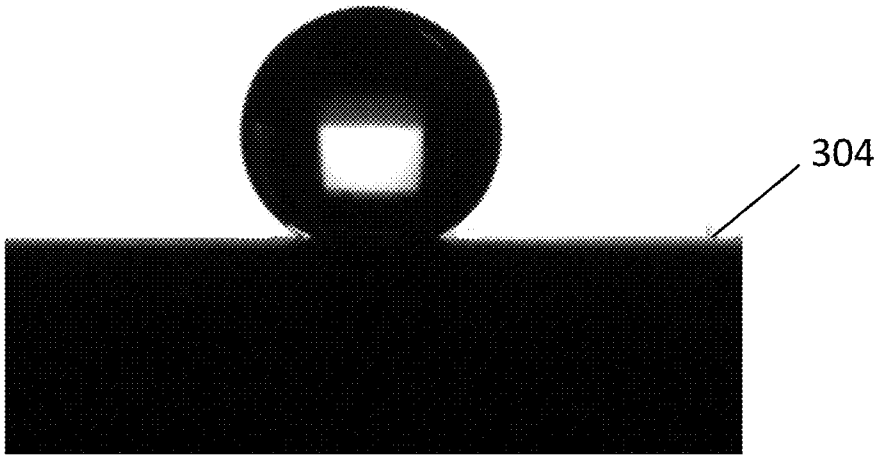
FIG. 8B is an image showing the contact angle of a water droplet on the surface of an as-cast high entropy alloy annealed at 1200° C. as prepared in accordance with one embodiment.

With reference finally to FIGS. 8A and 8B, there are provided images showing the contact angles of the porous annealed HEAs with silanization modification. The term "contact angle" is the angle between a drop of water and a flat and horizontal surface i.e. the surface of the HEAs upon which the droplet is placed. It is appreciated that a material may be considered as hydrophobic if the contact angle for water of greater than about 90°, preferred greater than about 100° and more preferred of about 110°. In this example, the contact angles for the porous annealed HEAs 302 and 304 were determined to be 134.5° and 140° respectively. That is, the hydrophobicity of the HEA 304 annealed at a higher temperature is higher than that of the HEA 302 annealed at a lower temperature.

The present invention is advantageous in that the HEA possesses microstructures that can be tuned by adjusting the processing conditions such as the annealing temperature and duration. The length scale of the microstructures may be tuned from several tens of nanometers to several microns. With different microstructures, the HEAs may have superior hardness, total density, hydrophobicity as well as large specific surface area for catalytic applications. In particular, the total density of the presently claimed HEAs may approach the commercial light weight alloy such as TiAlV alloy and can be used to fabricate small light weight devices.

In addition, the method of the present invention involves easy and inexpensive procedures. The method may also be used to produce a HEA structure with a size of, for example 100 mm by 10 mm by 1 mm, which is larger than similar structure fabricated by other techniques.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

Any reference to prior art contained herein is not to be taken as an admission that the information is common general knowledge, unless otherwise indicated.

The invention claimed is:

1. A method for preparing a high entropy alloy structure comprising the steps of:

A. preparing an alloy by arc melting raw materials comprising five or more elements;

B. drop casting the melted alloy into a cooled mold and cooling to form a bulk alloy with eutectic microstructure therein; and C. acid etching the bulk alloy with an etching solution to form a bulk porous structure with eutectic microstructure therein, wherein the bulk alloy is immersed into the etching solution comprising Aqua Regia at from 50° C. to 100° C. for at least 2 hours, wherein step C comprises:

C1. immersing the bulk alloy into the etching solution to form the bulk porous structure.

2. The method according to claim 1, further including step C0, prior to step C, of cutting the bulk alloy into smaller pieces.

3. The method according to claim 1, wherein the raw materials include Cobalt, Chromium, Iron, and Nickel provided in equal atomic ratios.

4. The method according to claim 1, wherein the raw materials have a high purity of >99.90%.

5. The method according to claim 1, wherein the mold is made of copper.

6. The method according to claim 1, wherein the alloy in step A is arc melted within an argon atmosphere with a pressure less than $8\times10^{-4}$ Pa.

7. The method according to claim 1, wherein the bulk alloy is rinsed for at least 3 minutes with ethyl alcohol.

8. The method according to claim 1, further including step B1, during step B, of rotatably cooling the bulk alloy.

9. The method according to claim 8, wherein the alloy in step B1 is rotatably cooled within an argon atmosphere with a pressure less than $1\times10^{-3}$ Pa.

10. The method according to claim 1, further including step B1', after step B, of heat-treating the bulk alloy to form a bulk structure with coarsened eutectic microstructure therein.

11. The method according to claim 10, wherein step B1' includes step B2' of annealing the bulk alloy to form an annealed alloy, wherein the annealing of the bulk alloy facilitates growing of eutectic microstructures.

12. The method according to claim 11, wherein step B1' further includes step B3', after step B2', of water quenching the annealed alloy.

13. The method according to claim 11, wherein the bulk alloy is annealed at a temperature of at least 800° C. or at least 60% of the alloy melting point for at least 5 hours.

14. The method according to claim 1, wherein the raw materials are Cobalt, Chromium, Iron, Nickel and Niobium.

15. The method according to claim 14, wherein the Cobalt, Chromium, Iron, and Nickel are provided in equal atomic ratios.

16. The method according to claim 14, wherein Cobalt, Chromium, Iron, Nickel and Niobium are provided in the atomic ratios of 1:1:1:1:0.48.

* * * * *